US006939596B2

(12) United States Patent
Coronel et al.

(10) Patent No.: US 6,939,596 B2
(45) Date of Patent: Sep. 6, 2005

(54) FASTENER WITH FIBER-COVERED ANCHOR AND SEALING ELEMENTS

(75) Inventors: Wolfgang Coronel, Macon, GA (US); Craig Jay Graham, Eastman, GA (US); Nobuo Fujisawa, Macon, GA (US)

(73) Assignee: YKK Corporation of America, Marietta, GA (US)

( * ) Notice: Subject to any disclaimer, the term of this patent is extended or adjusted under 35 U.S.C. 154(b) by 43 days.

(21) Appl. No.: 10/464,697

(22) Filed: Jun. 18, 2003

(65) Prior Publication Data

US 2004/0258878 A1 Dec. 23, 2004

(51) Int. Cl.[7] ..... B32B 3/06; A44B 21/00

(52) U.S. Cl. ..... 428/99; 428/100; 24/442; 24/451

(58) Field of Search ..... 428/99, 100, 900; 24/442, 451

(56) References Cited

U.S. PATENT DOCUMENTS

| | | | |
|---|---|---|---|
| 4,563,380 | A | 1/1986 | Black et al. |
| 4,617,214 | A | 10/1986 | Billerant |
| 4,710,414 | A | 12/1987 | Northrup et al. |
| 4,842,916 | A | 6/1989 | Ogawa et al. |
| 5,061,450 | A | 10/1991 | Aoyagi |
| 5,500,268 | A | 3/1996 | Billarant |
| 5,766,723 | A | 6/1998 | Oborny et al. |
| 5,945,193 | A | 8/1999 | Pollard et al. |
| 6,468,624 | B1 | 10/2002 | Fujisawa et al. |

*Primary Examiner*—Alexander S. Thomas
(74) *Attorney, Agent, or Firm*—Michael S. Leonard; Everest Intellectual Property Law Group

(57) ABSTRACT

A fastener is disclosed with a fiber-covered element for anchoring the fastener in a finished foam seat cushion, and/or a fiber-covered element for sealing the fastening members of the fastener against fouling during the seat cushion molding process. The fiber-covered elements can additionally be magnetically attractable, and serve to temporarily secure the fastener to the forming mold during the molding process.

19 Claims, 9 Drawing Sheets

FASTENER WITH FIBER-COVERED ANCHOR AND SEALING ELEMENTS

This invention is in the area of fasteners which are molded into foam seat cushions in order to engage a seat cover, specifically a fastener with a fiber-covered element for anchoring the fastener in the finished foam seat cushion, and/or a fiber-covered element for sealing the fastening members of the fastener against fouling during the molding process. The fiber-covered elements can additionally be magnetically attractable, and serve to temporarily secure the fastener to the forming mold during the molding process.

Description of the Related Art

The invention encompasses different aspects of fasteners which are molded into foam seat cushions—means to hold the fastener temporarily to the cushion forming mold, means to seal the fastening members against fouling during the molding process, and means for anchoring the fastener in the finished foam seat cushion. In addition, the invention is suitable for use with deep-groove fasteners that hold a seat cover within the deep groove of a highly contoured seat cushion.

As to the first aspect, various methods of magnetically securing a fastener to a forming mold are disclosed in the art. These include:

A steel strip between the fastener backing and the anchor layer, as in U.S. Pat. No. 4,710,414 to Northrup et al.; magnetic particles or wire molded into or attached to the fastener layer, as in U.S. Pat. No. 5,766,723 to Oborny et al.; and a magnetically attractable wire held in place between the hooks on the engaging face of the fastener, as in applicant's own U.S. Pat. No. 6,468,624.

As to the second aspect, various methods for sealing the fastening members against fouling are shown in the art. These include:

Foam layers located along the longitudinal sides of the fastener strip, as in U.S. Pat. No. 5,500,268 to Billerant; flexible sealing lips that seal against the sides of the mold recess, as in U.S. Pat. No. 5,061,540 to Cripps et al.; and bunched fiber or synthetic resin placed along the longitudinal sides of the fastener strip, which melts and forms a seal during the molding process, as in U.S. Pat. No. 4,842,916 to Ogawa et al. In the Ogawa patent, the fiber is heaped directly onto the base layer of the fastener strip, and does not cover a distinct element separate from the base layer of the fastener strip, as in the invention.

As to the third aspect, various methods for anchoring the fastener within the finished foam seat cushion are disclosed in the art. These include:

Mushroom-headed projections located on the back (non-engagement) side of the fastener strip, as in U.S. Pat. No. 4,617,214 to Billerant; an open-pore foam pad attached to the back of the fastener strip, as in U.S. Pat. No. 4,563,380 to Black et al.; and a three-dimensional pattern embossed onto the fastener backing, as in U.S. Pat. No. 5,945,193 to Pollard et al.

In addition, a deep-groove fastener on which the fiber-covered anchor and sealing elements of the invention can be employed is shown in applicant's U.S. patent application Ser. No. 10/139,162.

As can be seen, none of the above prior art discloses a fastener wherein one fastener element performs two of the three functions of magnetic holding, sealing, and anchoring—for example, combined magnetic holding and sealing, or combined magnetic holding and anchoring. In addition, none of the above prior art discloses a single material—for example, the fiber-covered wire of the invention—which can be used for both sealing and anchoring purposes. Thus it can be seen that a fastener with a combined magnetic holding method and sealing method, and/or a combined magnetic holding method and anchoring method, whose sealing and anchoring purposes are achieved with the same material and whose combined methods can also be employed in a deep-groove application, would be a significant improvement over the prior art.

Accordingly, several objects and advantages of the invention are:

The fiber-covered anchor element provides effective anchoring of the fastener within the finished foam seat cushion, and the fiber-covered sealing element also provides effective sealing of the fastening members against fouling during the seat cushion molding process.

The dual-function (sealing and anchoring) fibers can be attached to a magnetically attractable wire or filament, such that the fiber-covered element performs the combined function of securing the fastener to the mold and anchoring the fastener in the finished foam seat cushion, and/or the combined function of securing the fastener to the mold and sealing the fastening members against fouling during the molding process. The invention thus yields manufacturing efficiencies, by having a single element of the fastener perform multiple functions.

The inventive aspects can be employed in flat fastener strips used to attach seat covers to generally flat seat cushions, and can also be employed in deep-groove fasteners that hold a seat cover within the deep grooves of highly contoured seat cushions.

Further objects and advantages of the invention will become apparent from a consideration of the drawings and ensuing description.

SUMMARY

The invention is a fastener with a fiber-covered element for anchoring the fastener in the finished foam seat cushion, and/or a fiber-covered element for sealing the fastening members of the fastener against fouling during the molding process. The fiber-covered elements can additionally be magnetically attractable, and serve to temporarily secure the fastener to the forming mold during the molding process.

DETAILED DESCRIPTION OF THE INVENTION

Figure 1:
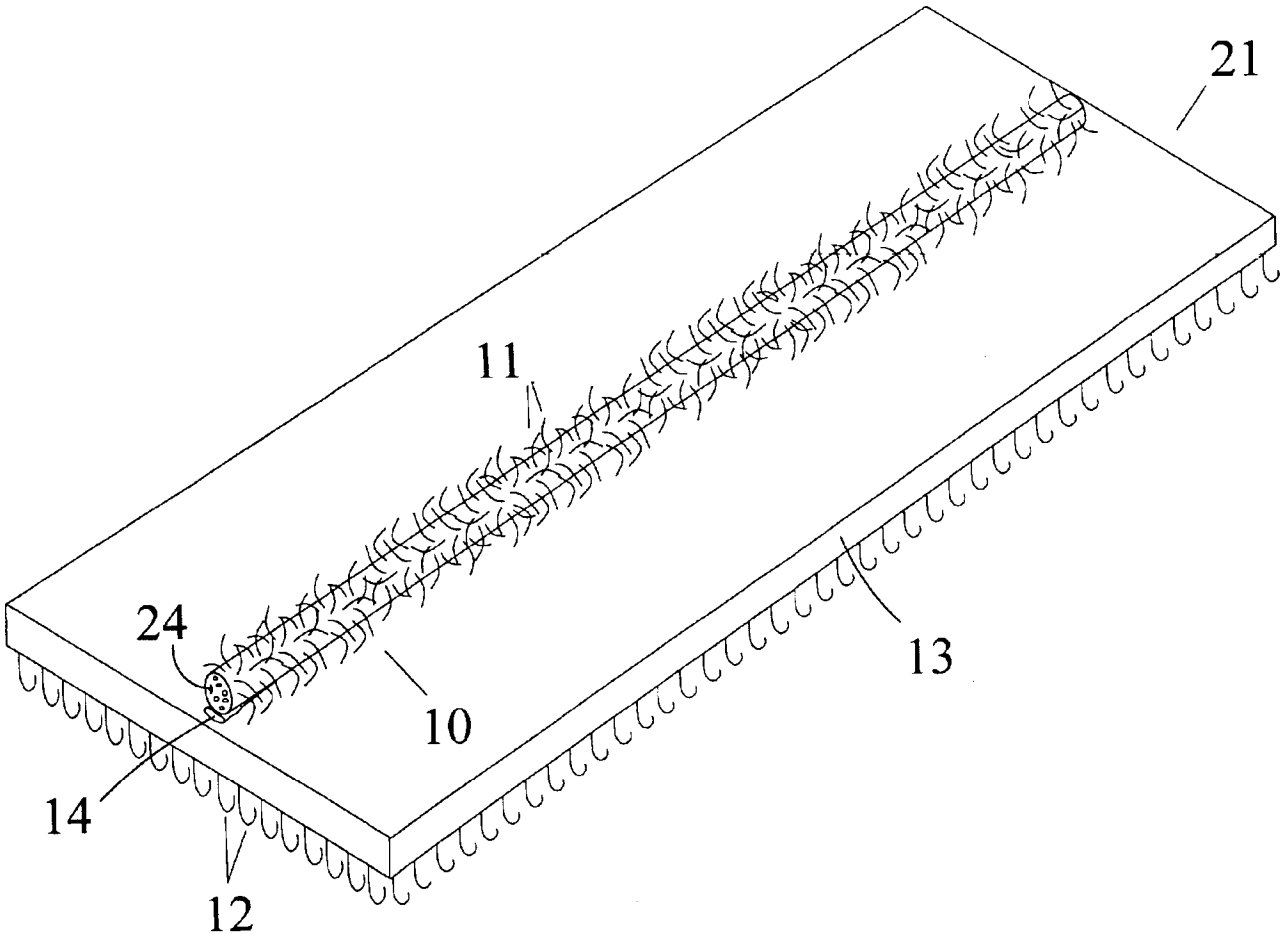
FIG. 1 is a perspective view of the fastener, showing the fiber-covered anchor element attached to the back (non-hook) side of the fastener.

The following provides a list of the reference characters used in the drawings:

10. Anchor wire
11. Fibers
12. Hooks
13. Base layer
14. Adhesive
15. Anchor buttons
16. Sealing wire
17. Fastening members
18. Sealing strip
19. Forming mold
20. Deep-groove pedestal
21. Fastener
22. Foam seat cushion
23. Anchor layer
24. Magnetically attractable particles
25. Interior cavity
26. Anchor member As shown in FIG. 1, fastener 21 of the invention is rectangular in shape, and has a fiber-covered anchor wire 10 attached to its back (non-hook) side. Anchor wire 10 is generally circular in cross-section, and extends along the longitudinal direction of fastener 21. Fibers 11 are attached to anchor wire 10 in any suitable manner known in the art, and anchor wire 10 is itself attached to the back of base layer 13 by adhesive 14. A plurality of hooks 12 are located on the front (hook side) of base layer 13. Means for sealing the sides and ends of the front side of base layer 13 against liquid intrusion, thus preventing hooks 12 from fouling during the foam cushion molding process, are not shown but are known in the art, and any suitable side-sealing or end-sealing means can be used. It should be understood that one such suitable sealing means is the fiber-covered sealing wire 16 shown in FIG. 7, and this sealing means is heretofore not known in the art.

Figure 7:
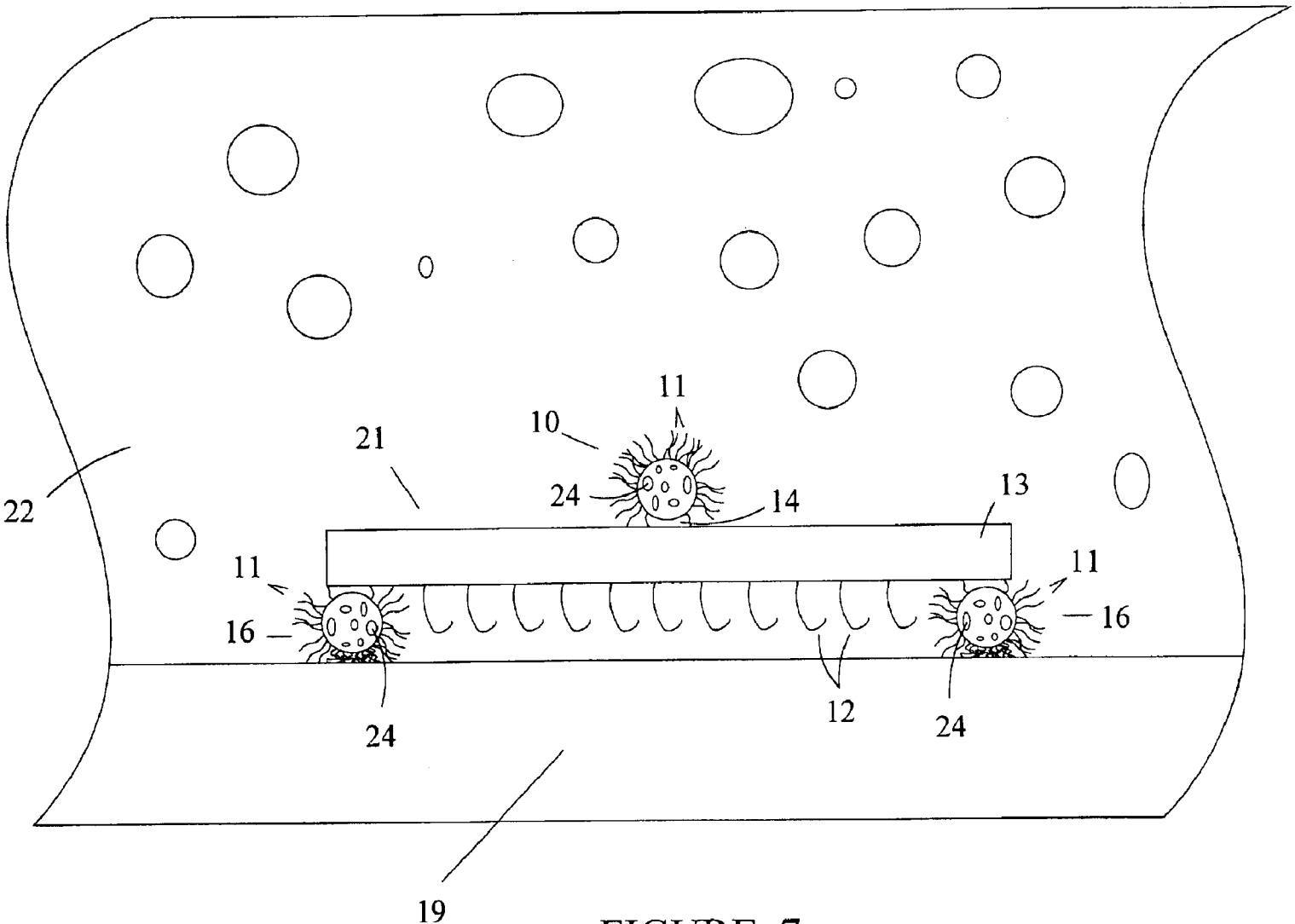
FIG. 7 is a cutaway end view of an embodiment, in position on the surface of a forming mold, wherein elongated fiber-covered sealing elements located along the longitudinal sides of the hook layer are used to seal the fastening members against fouling during the forming process.

Anchor wire 10 is comprised of magnetically attractable material, exemplified here by plastic monofilament with magnetically attractable particles 24, such that when fastener 21 is placed on a magnetized forming mold 19 as shown in FIG. 7, a magnetic attraction is created between anchor wire 10 and the forming mold, and this magnetic attraction helps secure fastener 21 to forming mold 19.

Figure 2:
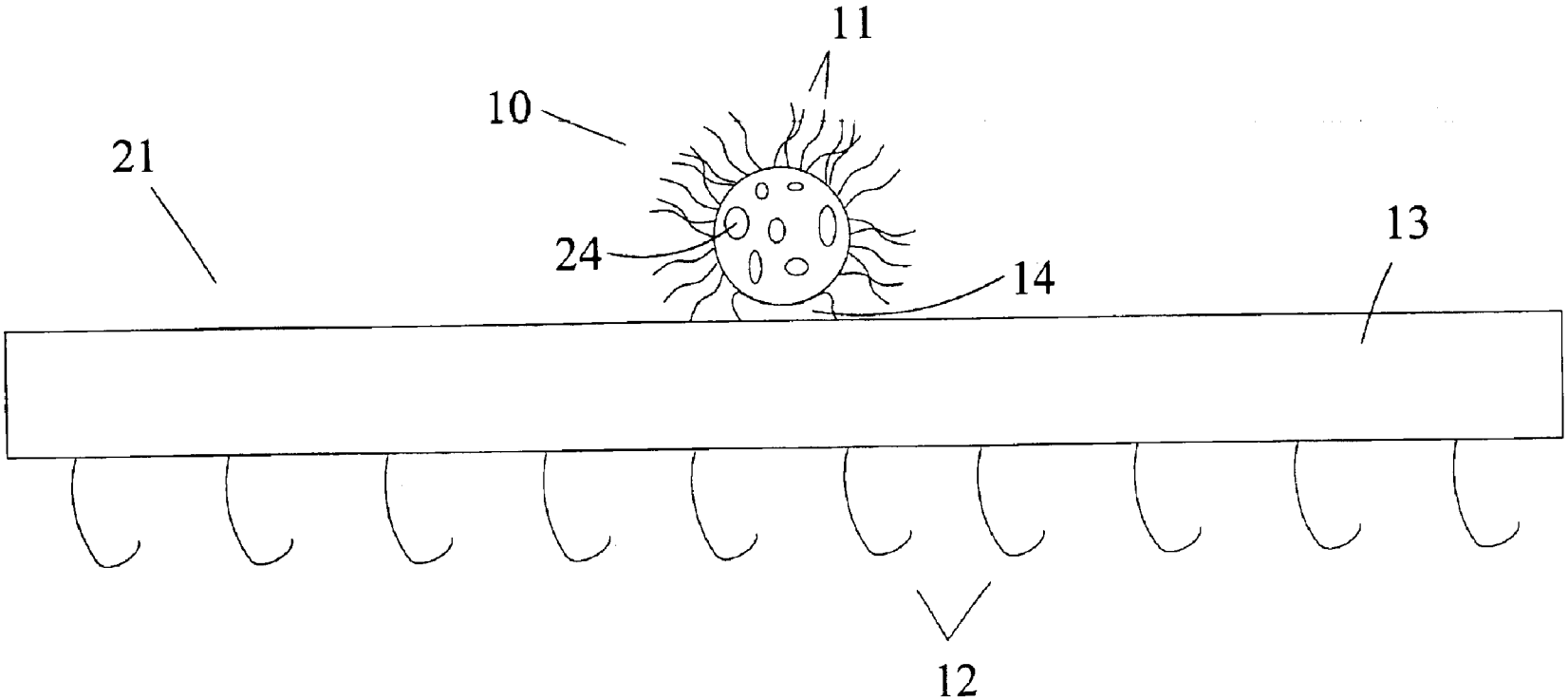
FIG. 2 is an end view of the fastener illustrated in FIG. 1, further illustrating the manner in which the fiber-covered anchor element is attached to the back of the base layer with adhesive.

FIG. 2 is an end view of the fastener 21 illustrated in FIG. 1, further illustrating the manner in which fiber-covered anchor wire 10 is attached to the back of base layer 13 with adhesive 14. Other parts are the same as in FIG. 1.

Figure 3:
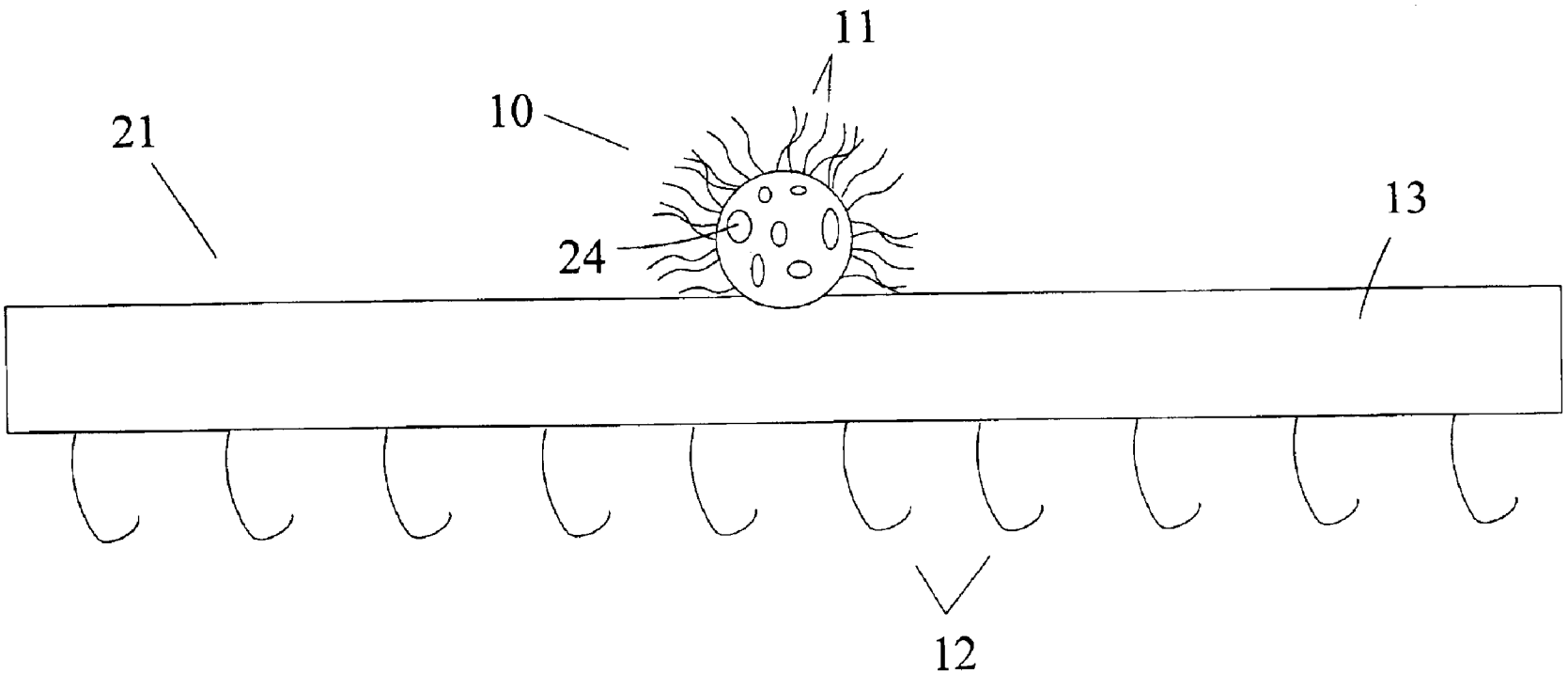
FIG. 3 is an end view of an alternative embodiment, wherein the fiber-covered anchor element is partially embedded in the back of the base layer, rather than being attached with adhesive.

FIG. 3 is an end view of an alternative embodiment, wherein fiber-covered anchor wire 10 is partially embedded in the back of base layer 13, rather than being attached with adhesive 14 as in FIG. 2. Other parts are the same as in FIG. 2.

Figure 4:
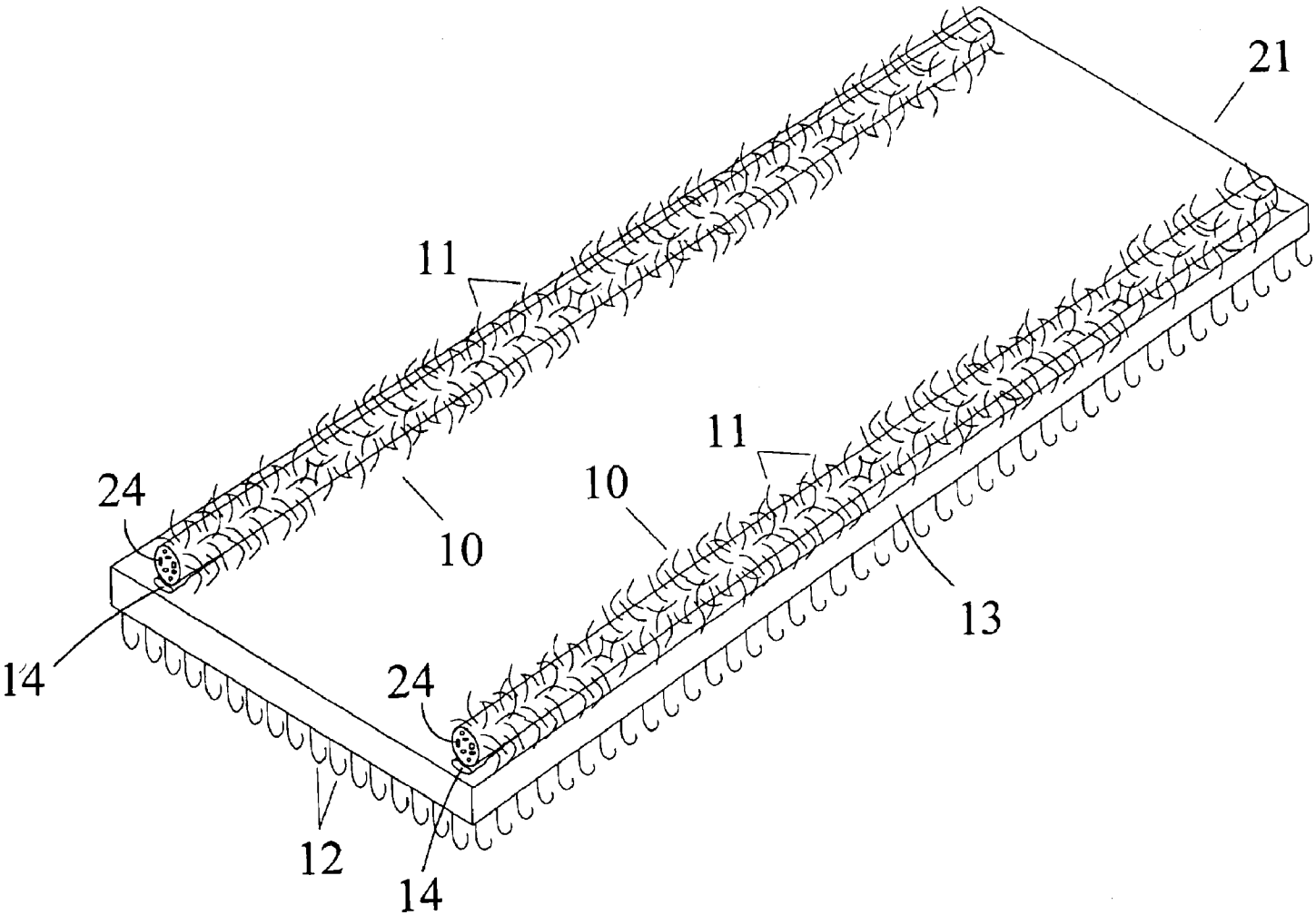
FIG. 4 illustrates another alternative embodiment, wherein two fiber-covered anchor elements are located at the longitudinal sides of the back of the base layer.

FIG. 4 illustrates another alternative embodiment, wherein two fiber-covered anchor wires 10 are located at the longitudinal sides of the back of base layer 13. Other parts are the same as in FIG. 1.

Figure 5:
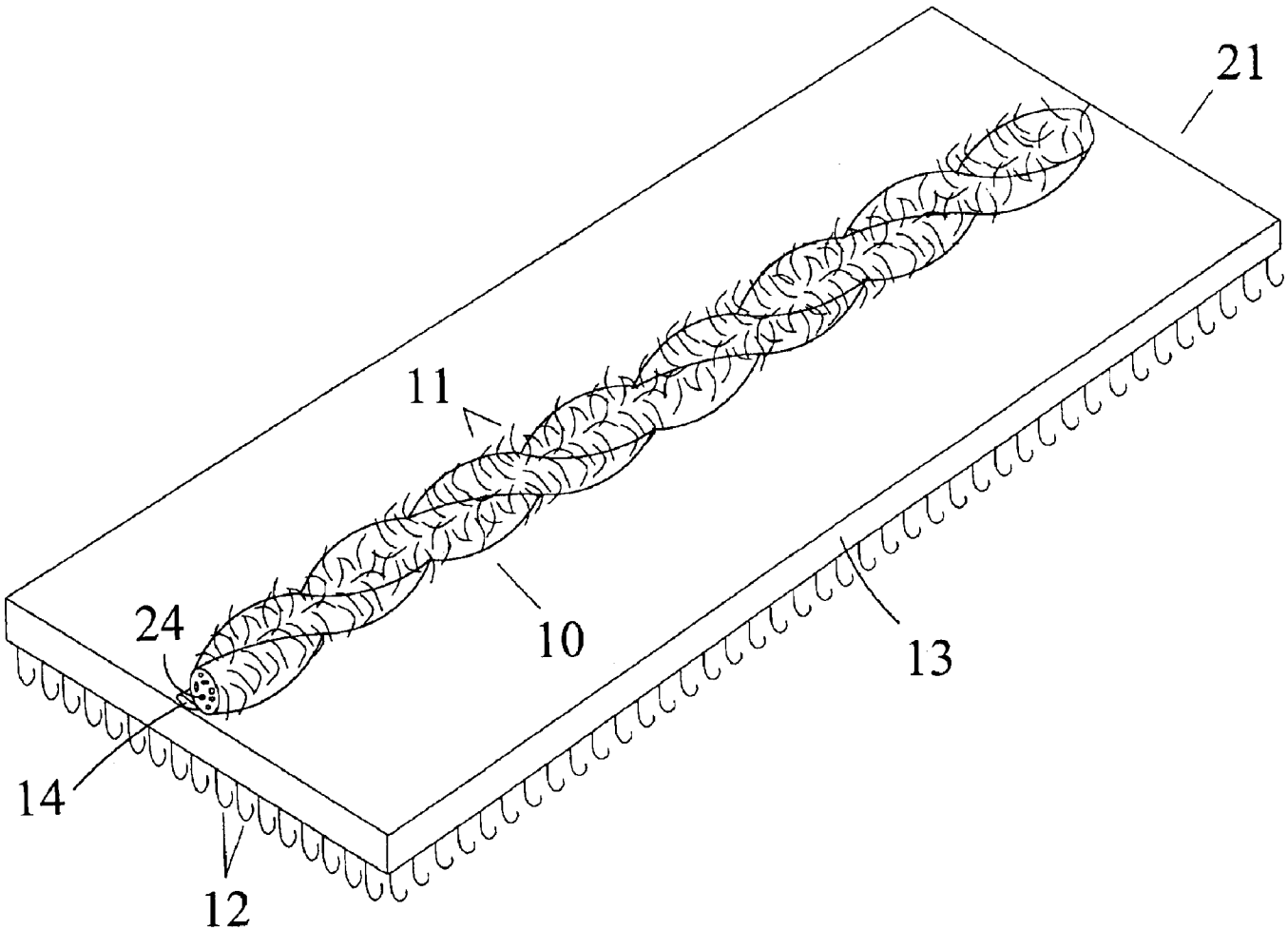
FIG. 5 illustrates another alternative embodiment, wherein two fiber-covered anchor elements are twisted together and attached to the back of the base layer.

FIG. 5 illustrates another alternative embodiment, wherein two fiber-covered anchor wires 10 are twisted together and attached to the back of base layer 13. It can be appreciated that the twisted nature of anchor wires 10 increases the anchoring surface area, thus anchoring fastener 21 more securely when fastener 21 is molded into a foam seat cushion.

Figure 6:
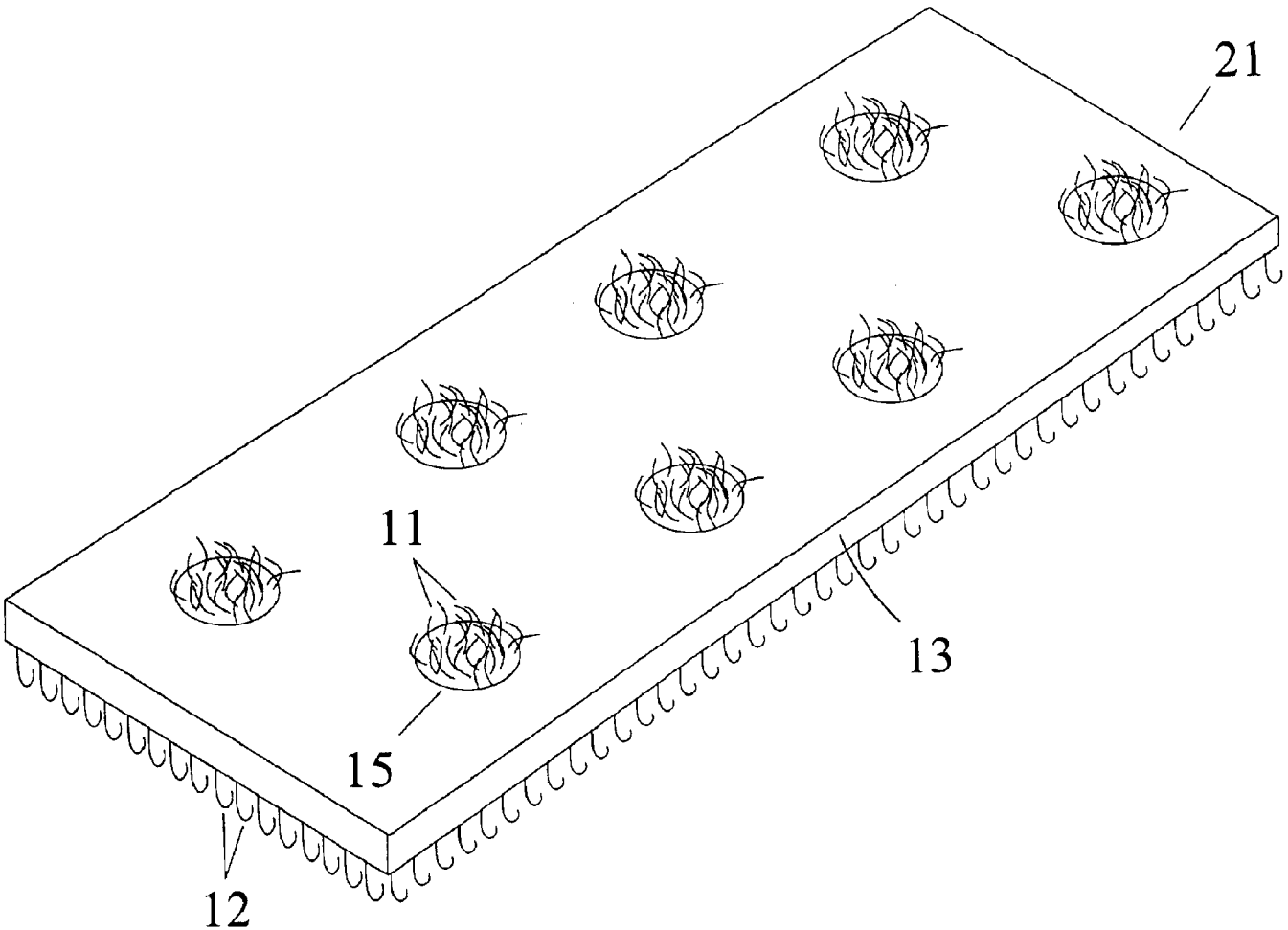
FIG. 6 illustrates another alternative embodiment, wherein the fiber-covered anchor element comprises a plurality of fiber-covered buttons attached to the back of the base layer.

Another alternative embodiment is illustrated in FIG. 6. In this embodiment, the fiber-covered anchor element comprises a plurality of fiber-covered buttons attached to the back of base layer 13. Fibers 11 are attached to anchor buttons 15 in any suitable manner known in the art. Other non-anchoring parts are the same as in FIG. 1.

FIG. 7 is a cutaway end view of another embodiment, in position on the surface of a forming mold 19. In this embodiment, fastener 21 has elongated fiber-covered sealing wires 16 located along the longitudinal sides of the front (hook side) of fastener 21. Sealing wires 16 are covered with fibers 11, and serve to seal hooks 12 against fouling during the forming process. Fastener 21 also has an anchor wire 10 located on the back of base layer 13, as in FIG. 1, 2, or 3. Foam seat cushion 22 is also shown in FIG. 7, and it can be seen that fibers 11 on anchor wire 10 extend into the body of foam seat cushion 22 after it is molded, thereby increasing the anchoring effect of fastener 21 in foam seat cushion 22.

As discussed earlier, anchor wire 10 is comprised of a plastic monofilament containing magnetically attractable particles 24. In the FIG. 7 embodiment, sealing wires 16 are also comprised of a plastic monofilament containing magnetically attractable particles 24, such that a magnetic attraction is created between sealing wires 16 and forming mold 19. This magnetic attraction helps secure fastener 21 to forming mold 19, and also increases the sealing effectiveness of fibers 11 and sealing wires 16.

Figure 8:
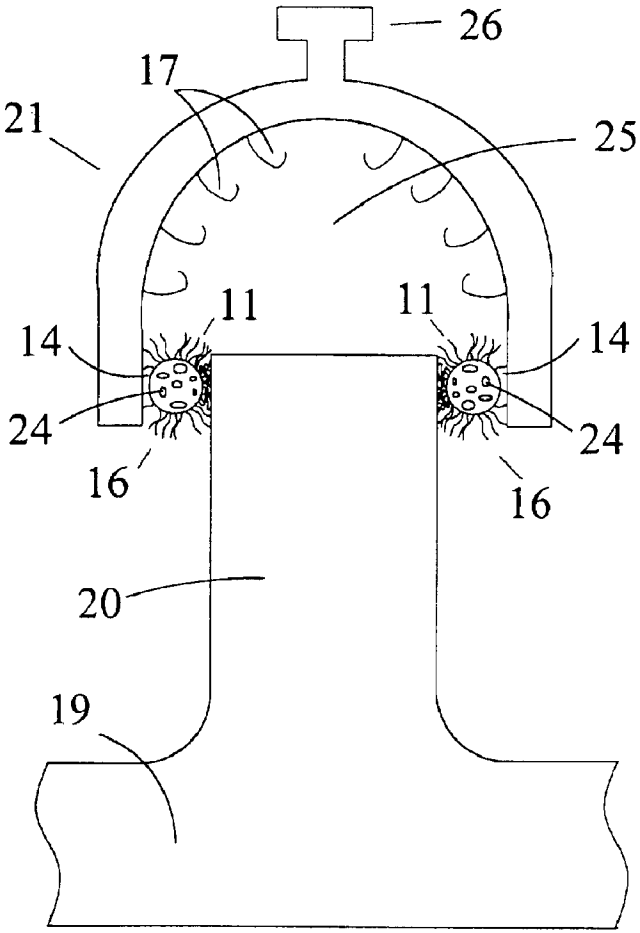
FIG. 8 is a cutaway end view of another embodiment, in position on a deep-groove pedestal of a forming mold, which is suitable for use as a molded-in deep-groove fastener.

FIG. 8 is a cutaway end view of another embodiment, shown in position on a deep-groove pedestal 20 of a forming mold 19. In this embodiment, fastener 21 has an elongated body and a generally concave cross section defining an elongated interior cavity 25, as shown in applicant's U.S. patent application Ser. No. 10/139,162. A plurality of fastening members 17 are located on the surface of interior cavity 25. Fastening members 17 are suitable for engaging loop or other material attached to the underside of a seat cover. Anchor member 26 is located on the exterior, non-cavity surface of fastener 21, to aid in anchoring the invention within a foam seat cushion after the seat cushion molding process is complete.

In the FIG. 8 embodiment, fastener 21 also has an elongated sealing wire 16, with attached fibers 11, located on each side of the fastener 21 concavity, such that sealing wires 16 seal interior cavity 25 against liquid intrusion and resultant fouling of fastening members 17 during the molding process. Fastener 21 also has an anchor member 26 located on its exterior. It should be understood that because FIG. 8 is a cutaway end view, the ends of fastener 21 are not shown. The ends of fastener 21 can be sealed against liquid intrusion and resultant fouling of fastening members 17 during the molding process in various ways. As just two examples, the ends of fastener can be crimped together either mechanically, by heat, or sonic welding; alternatively, covers can be placed over the ends of fastener 21 to accomplish the same result.

Figure 9:
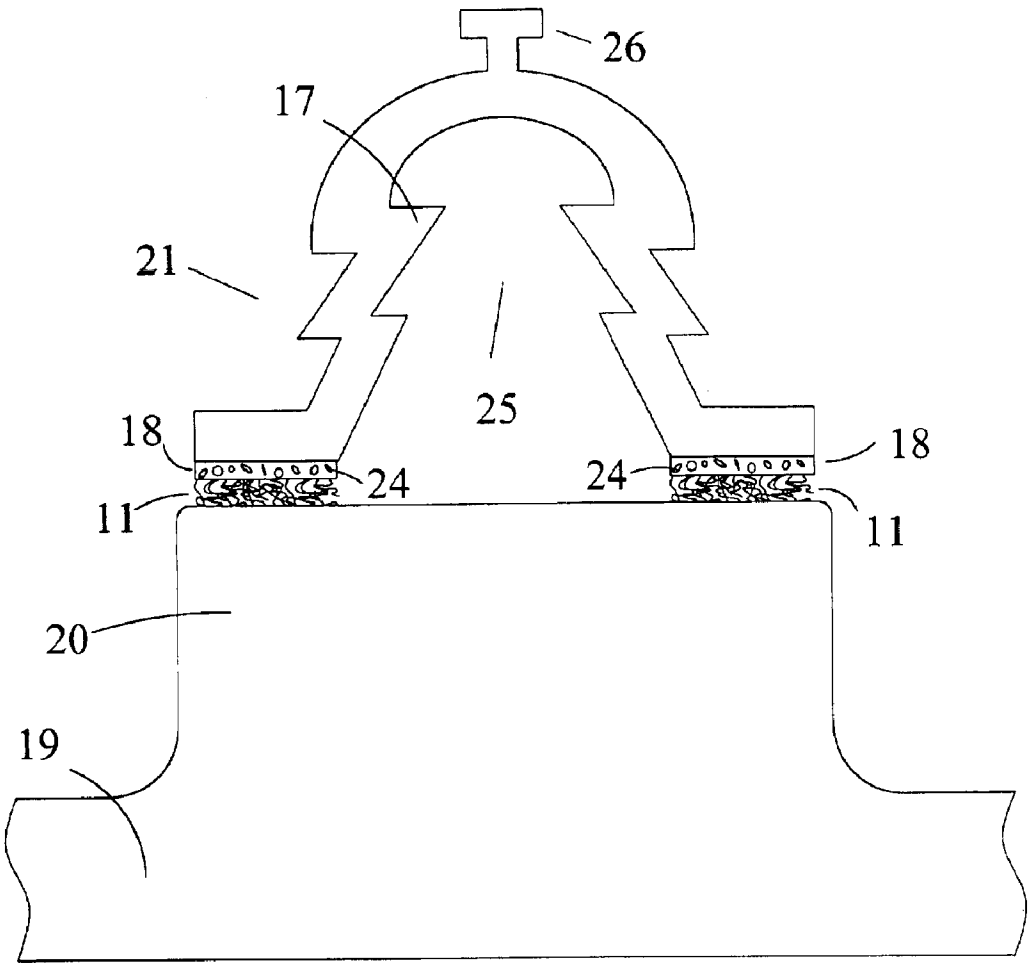
FIG. 9 illustrates another embodiment similar to FIG. 8, except that the fiber-covered sealing elements seal against the top surface of the deep-groove pedestal, rather than the sides of the pedestal as in FIG. 8.

FIG. 9 illustrates another embodiment similar to FIG. 8. However, in this embodiment sealing strips 18, covered with fibers 11 and having a rectangular cross-section and a generally flat pedestal-proximate surface, seal against the top surface of deep-groove pedestal 20, rather than against the sides of deep-groove pedestal 20 as in FIG. 8.

Conclusions, Ramifications, and Scope:

Thus the reader will see that this invention provides a very effective way of anchoring a fastener within a foam seat cushion, as well as sealing that fastener against fouling of the fastening members during the foam seat cushion molding process.

While the above descriptions contain many specificities, these shall not be construed as limitations on the scope of the invention, but rather as exemplifications of embodiments thereof. Many other variations are possible. Examples of just a few of the possible variations follow:

The fiber-covered anchor element and fiber-covered sealing element can have other shapes and sizes besides those shown in the figures and described above. As just a few examples, the fiber-covered anchor element can be a flat strip instead of a round wire, and does not need to be elongated. The fiber-covered sealing element can be an elongated flat strip instead of having an elongated shape that is circular in cross-section.

The fiber-covered anchor element and fiber-covered sealing element can be formed from non-magnetically attractable material, or wholly magnetically attractable material such as iron or steel, or a composite material such as plastic monofilament with magnetically attractable particles incorporated within or attached thereto. Further, both the fiber-covered anchor element and fiber-covered sealing element can comprise two or more twisted wires. It should be understood that the wires shown can be made of metal, non-metal, or a composite of metal and non-metal.

The fiber-covered anchor element can be located differently on the back of the fastener than is shown in the various embodiments. It can also be oriented differently—as just two examples, it can be placed transversely across the back of the fastener, or slanted diagonally. The various embodiments can also be constructed with or without the anchor element shown. Similarly, the fiber-covered sealing element can be located differently than is shown in the various embodiments. As just one example, it can be placed transversely across the front face of the fastener, to seal the ends of the fastener against liquid intrusion.

The fibers can be adhesively attached to the fiber-covered anchor element or fiber-covered sealing element, partially embedded in the fiber-covered anchor element and fiber-covered sealing element, or attached using any other suitable means. As just one example, the fibers can be attached by twisting, intertwining, or otherwise entangling the fibers with the anchor element or sealing element. This intertwining can be accomplished by twisting two or more wires together as shown in the embodiment of FIG. 5, except that the fibers are caught and retained between the twisted wires. Because the fibers are retained between the twisted wires, no other fiber attachment means is required.

The fastener strip can be of any shape, including circular or square-shaped, and not just the rectangular strip shape shown in the various embodiments. The basic concept of the invention—a fiber-covered anchor or sealing element—is applicable to fastener strips having many different shapes.

The fibers that cover the anchor element or sealing element can be single filaments formed from any suitable material, or can also be of multi-filament or twisted construction, or can also be formed in continuous or interrupted loops. The fibers can completely or partially cover the anchor element or sealing element. The fibers can be of equal or different lengths. Further, the density of the covering fibers can be different than that shown in the various embodiments.

The engaging elements can be of different shapes other than the J-hooks and fastening members shown in the various embodiments. Loop material or other engaging elements can also be used instead of hooks.

Finally, the inventive aspects of the invention can be used not just in molded-in fasteners that secure a seat cover to a foam seat cushion, but also in molded-in fasteners that secure any molded object to a second object.

Accordingly, the scope of the invention should be determined not by the embodiments illustrated, but by the appended claims and their legal equivalents.

What is claimed is:

1. A fastener adapted for molding into an object, comprising:

(a) a base layer having a front side and a back side, and (b) at least one fastening member located on said front side of said base layer, and (c) at least one fiber-covered anchor element located on said back side of said base layer, whereby said fastener is securely retained within said object on completion of a molding process, and said object can thus be fastened to a second object, and wherein said fiber-covered anchor element comprises at least one elongated wire.

2. The fastener of claim 1, wherein said wire is a plastic monofilament having magnetically attractable particles incorporated therein.

3. The fastener of claim 1, wherein said wire is disposed down the longitudinal center of said base layer.

4. The fastener of claim 1, wherein two elongated wires are disposed down opposing side edges of said base layer.

5. The fastener of claim 1, wherein said fiber-covered anchor element comprises a twisted pair of elongated wires.

6. A fastener adapted for molding into an object, comprising:

(a) a base layer having a front side and a back side, and (b) at least one fastening member located on said front side of said base layer, and (c) at least one fiber-covered sealing element disposed along an edge of said front side of said base layer and outside of said at least one fastening member, whereby said fastening members are sealed against fouling during a molding process, and said object can thus be fastened to a second object.

7. The fastener of claim 6, wherein said fiber-covered sealing element comprises an elongated wire.

8. The fastener of claim 7, wherein said wire is a plastic monofilament having magnetically attractable particles incorporated therein.

9. The fastener of claim 6, wherein two fiber-covered sealing elements are disposed down opposing side edges of said base layer.

10. The fastener of claim 6, wherein said fastener also comprises a fiber-covered anchor element located on said back side of said base layer.

11. The fastener of claim 10, wherein said fiber-covered anchor element comprises at least one elongated wire.

12. The fastener of claim 11, wherein said wire is a plastic monofilament having magnetically attractable particles incorporated therein.

13. A fastener adapted for molding into an object, comprising:

(a) an elongated main body having an exterior surface, said main body being of a substantially concave shape defining an interior cavity, and (b) a plurality of fastening elements located on a surface of said interior cavity, and (c) two fiber-covered sealing elements located on opposing sides of said interior cavity, whereby said object can be fastened to a second object.

14. The fastener of claim 13, wherein said fiber-covered sealing elements comprise elongated wires.

15. The fastener of claim 14, wherein said wires are plastic monofilaments having magnetically attractable particles incorporated therein.

16. The fastener of claim 13, wherein said fastener also comprises an anchor element located on an exterior surface of said main body.

17. The fastener of claim 13, wherein said fiber-covered sealing elements comprise two sealing legs substantially flat along their bottom surface.

18. The fastener of claim 13, wherein said fiber-covered sealing elements have magnetically attractable particles incorporated therein.

19. A fastener adapted for molding into an object, comprising:

a base layer having a front side and a back side;

at least one fastening member located on said front side of said base layer;

a fiber-covered sealing element located on said front side of said base layer; and a fiber-covered anchor element located on said back side of said base layer;

whereby said at least one fastening member is sealed against fouling during a molding process, and said object can thus be fastened to a second object.

* * * * *